US006148933A

United States Patent [19]

Hay et al.

[11] Patent Number: 6,148,933

[45] Date of Patent: Nov. 21, 2000

[54] STEERING DEVICE FOR BOTTOMHOLE DRILLING ASSEMBLIES

[75] Inventors: Arthur D. Hay, Cheshire, Conn.; Mike H. Johnson, Spring, Tex.; Volker Krueger, Celle, Germany

[73] Assignee: Baker Hughes Incorporated, Houston, Tex.

[21] Appl. No.: 09/334,279

[22] Filed: Jun. 16, 1999

Related U.S. Application Data

[62] Division of application No. 08/805,492, Feb. 26, 1997, Pat. No. 5,957,221.

[60] Provisional application No. 60/012,444, Feb. 28, 1996.

[51] Int. Cl.[7] ..... E21B 7/04

[52] U.S. Cl. ..... 175/73; 175/325.2

[58] Field of Search ..... 175/61, 73, 74, 175/325.1, 325.2, 45, 76, 326

[56] References Cited

U.S. PATENT DOCUMENTS

| | | | |
|---|---|---|---|
| 2,421,997 | 6/1947 | Crake . | |
| 2,520,517 | 8/1950 | Taylor . | |
| 2,537,605 | 1/1951 | Sewell . | |
| 2,912,641 | 11/1959 | Ruble . | |
| 2,973,471 | 2/1961 | Armistead et al. . | |
| 3,443,650 | 5/1969 | Gstalder et al. . | |
| 3,552,505 | 1/1971 | Thompson et al. . | |
| 3,743,036 | 7/1973 | Feenstra et al. . | |
| 4,185,704 | 1/1980 | Nixon, Jr. . | |
| 4,452,321 | 6/1984 | Eriksson . | |
| 4,512,419 | 4/1985 | Rowley et al. . | |
| 4,512,423 | 4/1985 | Aumann et al. . | |
| 4,566,545 | 1/1986 | Story et al. . | |
| 4,732,930 | 3/1988 | Tanaka et al. . | |
| 4,784,229 | 11/1988 | Ostkamper et al. . | |
| 4,955,438 | 9/1990 | Juergens et al. . | |
| 5,100,933 | 3/1992 | Tanaka et al. . | |
| 5,107,942 | 4/1992 | Radford . | |
| 5,242,491 | 9/1993 | Mamada et al. . | |
| 5,274,018 | 12/1993 | Tanaka et al. . | |
| 5,339,913 | 8/1994 | Rives | 175/322 X |
| 5,341,886 | 8/1994 | Patton | 175/45 X |
| 5,403,893 | 4/1995 | Tanaka et al. . | |
| 5,419,405 | 5/1995 | Patton | 175/45 X |
| 5,439,064 | 8/1995 | Patton | 175/45 X |
| 5,957,221 | 9/1999 | Hay et al. | 175/44 |

FOREIGN PATENT DOCUMENTS

| | | |
|---|---|---|
| 883573 | 11/1961 | United Kingdom . |
| 2 271 791 | 4/1994 | United Kingdom . |
| WO 94/13928 | 6/1994 | WIPO . |
| WO 95/05521 | 2/1995 | WIPO . |
| WO 95/10683 | 4/1995 | WIPO . |

*Primary Examiner*—Roger Schoeppel
*Attorney, Agent, or Firm*—Trask Britt

[57] ABSTRACT

A coring apparatus permitting the taking of a non-rotating core sample and testing of same, as by NMR, prior to breakage and ejection from the apparatus. A core barrel is suspended from a rotating outer sleeve by one or more bearing assemblies which permit the core barrel to remain stationary during rotation of the sleeve with attached core bit for cutting the core. A core test device is fixed with respect to the core barrel on the outside thereof to test the core as it proceeds through the barrel. The apparatus optionally includes a directional detecting device such as an inclinometer and a compact set of circumferentially-spaced steering arms for changing the direction of the apparatus during coring.

20 Claims, 3 Drawing Sheets

STEERING DEVICE FOR BOTTOMHOLE DRILLING ASSEMBLIES

CROSS REFERENCE TO RELATED APPLICATION

This application is a divisional of application Ser. No. 08/805,492, filed Feb. 26, 1997 U.S. Pat. No. 5,957,221, which claims the benefit of U.S. Provisional Application No. 60/012,444, filed Feb. 28, 1996.

BACKGROUND OF THE INVENTION

1. Field of the Invention

The field of this invention relates to sampling and downhole testing techniques for subterranean formation cores, particularly applications using continuous nuclear magnetic resonance analyses of formation cores in a measurement-while-drilling mode.

2. State of the Art

It is desirable for the well operator to test the properties of the formation adjacent the wellbore. Frequently, properties such as permeability and porosity are measured using techniques, including, but not limited to, nuclear magnetic resonance (NMR), X-ray, or ultrasonic imaging.

One way of using techniques for measurement of formation properties is to drill the hole to a predetermined depth, remove the drillstring, and insert the source and receivers in a separate trip in the hole and use NMR to obtain the requisite information regarding the formation. This technique involves sending out signals and capturing echoes as the signals are reflected from the formation. This technique involved a great deal of uncertainty as to the accuracy of the readings obtained, in that it was dependent on a variety of variables, not all of which could be controlled with precision downhole.

Coring has also been another technique used to determine formation properties. In one prior technique, a core is obtained in the wellbore and brought to the surface where it is subjected to a variety of tests. This technique also created concerns regarding alteration of the properties of the core involved in the handling of the core to take it and bring it to the surface prior to taking measurements. Of paramount concern was how the physical shocks delivered to the core would affect its ability to mimic true downhole conditions and, therefore, lead to erroneous results when tested at the surface.

Other techniques have attempted to take a core while drilling a hole and take measurements of the core as it is being captured. These techniques which have involved NMR are illustrated in U.S. Pat. Nos. 2,973,471 and 2,912,641. In both of these patents, an old-style bit has a core barrel in the middle, which rotates with the bit. As the core advances in the core barrel as a net result of forward progress of the bit, the core passes through the alternating current and direct current fields and is ultimately ejected into the annulus.

The techniques shown in the two described patents have not been commercially employed in the field. One of the problems with the techniques illustrated in these two patents is that the core integrity is destroyed due to the employment of a rotating core barrel. The rotating core barrel, which moves in tandem with the bit, breaks the core as it enters the core barrel and before it crosses the direct current and radio frequency fields used in NMR. The result was that unreliable data is gathered about the core, particularly as to the properties of permeability and porosity which are greatly affected by cracking of the core. Additionally, the physical cracking of the core also affected readings for bound water, which is water that is not separable from the core mass.

SUMMARY OF THE INVENTION

An apparatus is disclosed that allows the taking of cores during drilling into a nonrotating core barrel. NMR measurements and tests are conducted on the core in the nonrotating barrel and, thereafter, the core is broken and ejected from the barrel into the wellbore annulus around the tool. In conjunction with a nonrotating core barrel, a sub is included in the bottomhole assembly, preferably adjacent to the bit, which, in conjunction with an inclinometer of known design, allows for real-time ability to control the movement of the bit to maintain a requisite orientation in a given drilling program. The preferred embodiment involves the use of a segmented permanent magnet to create direct current field lines, which configuration facilitates the flow of drilling fluid within the tool around the outside of the core barrel down to the drill bit so that effective drilling can take place.

The apparatus of the present invention overcomes the sampling drawbacks of prior techniques by allowing a sample to be captured using the nonrotating core barrel and run past the NMR equipment. Various techniques are then disclosed to break the core after the readings have been taken so that it can be easily and efficiently ejected into the annular space. A steering mechanism is also provided, as close as practicable, to the drill bit to allow for orientation changes during the drilling process in order to facilitate corrections to the direction of drilling and to provide such corrections as closely as possible on a real-time basis while the bit advances. The specific technique illustrated is usable in combination with the disclosed nonrotating core barrel, which, due to the space occupied by the core barrel, does not leave much space on the outside of the core barrel to provide the necessary mechanisms conventionally used for steering or centralizing.

Another advantage of the present invention is the provision of components of the NMR measurement system in such a configuration as to minimize any substantial impediment to the circulating mud which flows externally to the core barrel and through the drill bit to facilitate the drilling operation.

DETAILED DESCRIPTION OF THE INVENTION

Figure 1:
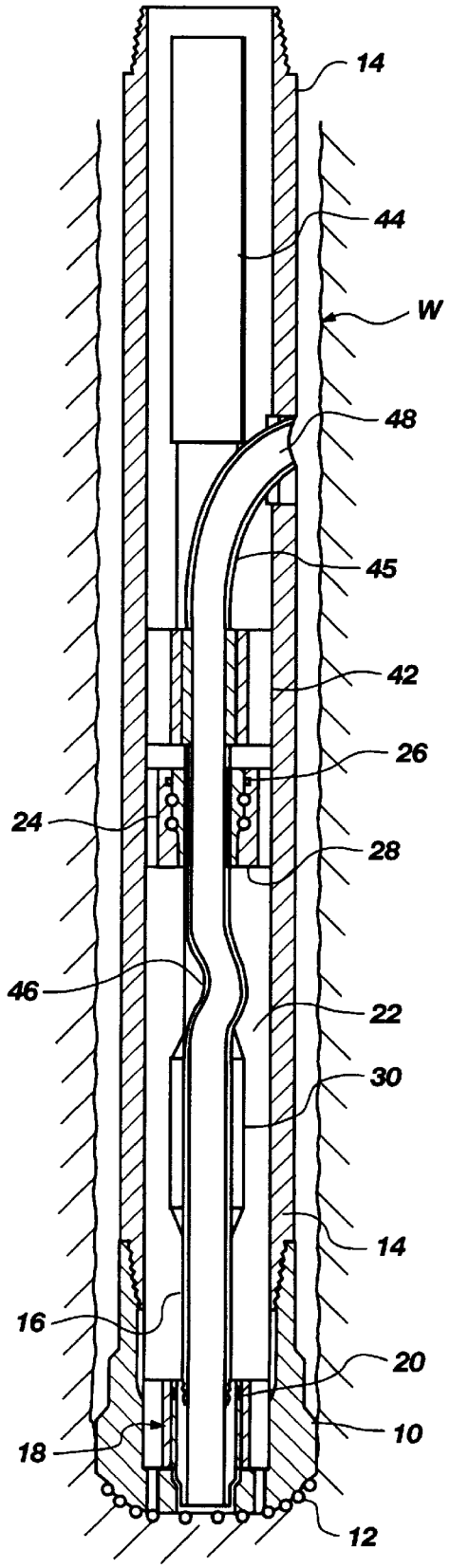
FIG. 1 illustrates a sectional elevational view showing the nonrotating core barrel and one of the techniques to break the core after various measurements have taken place.

FIG. 1 shows the general layout of the components, illustrating, at the bottom end of the bottomhole assembly, a core bit 10, which has a plurality of inserts 12, usually polycrystalline diamond compact (PDC) cutting elements, which cut into the formation upon rotation and application of weight on bit (WOB) to the bottomhole assembly to create the wellbore W. The core bit 10 is attached at its upper end to tubular sleeve or housing 14 which rotates with the core bit 10. Ultimately, the sleeve 14 is connected to the lower end of a pipe or tubing string (not shown) extending from the surface to the bottom hole assembly. Internal to the sleeve 14 is a core barrel 16 which is nonrotating with respect to the sleeve 14.

The core barrel 16 is supported by lower bearing assembly 18, which includes a seal assembly 20, to prevent the circulating mud which is in the annulus 22, formed between the core barrel 16 and the sleeve 14, from getting into the lower bearing assembly 18 and precluding rotation of the core bit 10 and sleeve 14 with respect to the core barrel 16. Lower bearing assembly 18 also includes longitudinal passages therethrough to allow the circulating mud to pass to core bit 10 on the exterior of core barrel 16 in annulus 22.

The nonrotating core barrel 16 also has an upper bearing assembly 24, which has a seal assembly 26, again to keep out the circulating mud in the annulus 22 from entering the upper bearing assembly 24. It should be noted that the seal assemblies 20 and 26 can be employed in upper and lower pairs, as required to isolate the circulating mud in the annulus 22 from the contacting bearing surfaces of the stationary core barrel 16 and the rotating assembly of the sleeve 14. Those skilled in the art will appreciate that a hub 28, which is affixed to the rotating sleeve 14 and supports a part of the upper bearing assembly 24, as well as seal assembly 26, has longitudinal passages therethrough to allow the circulating mud to pass.

Figure 3:
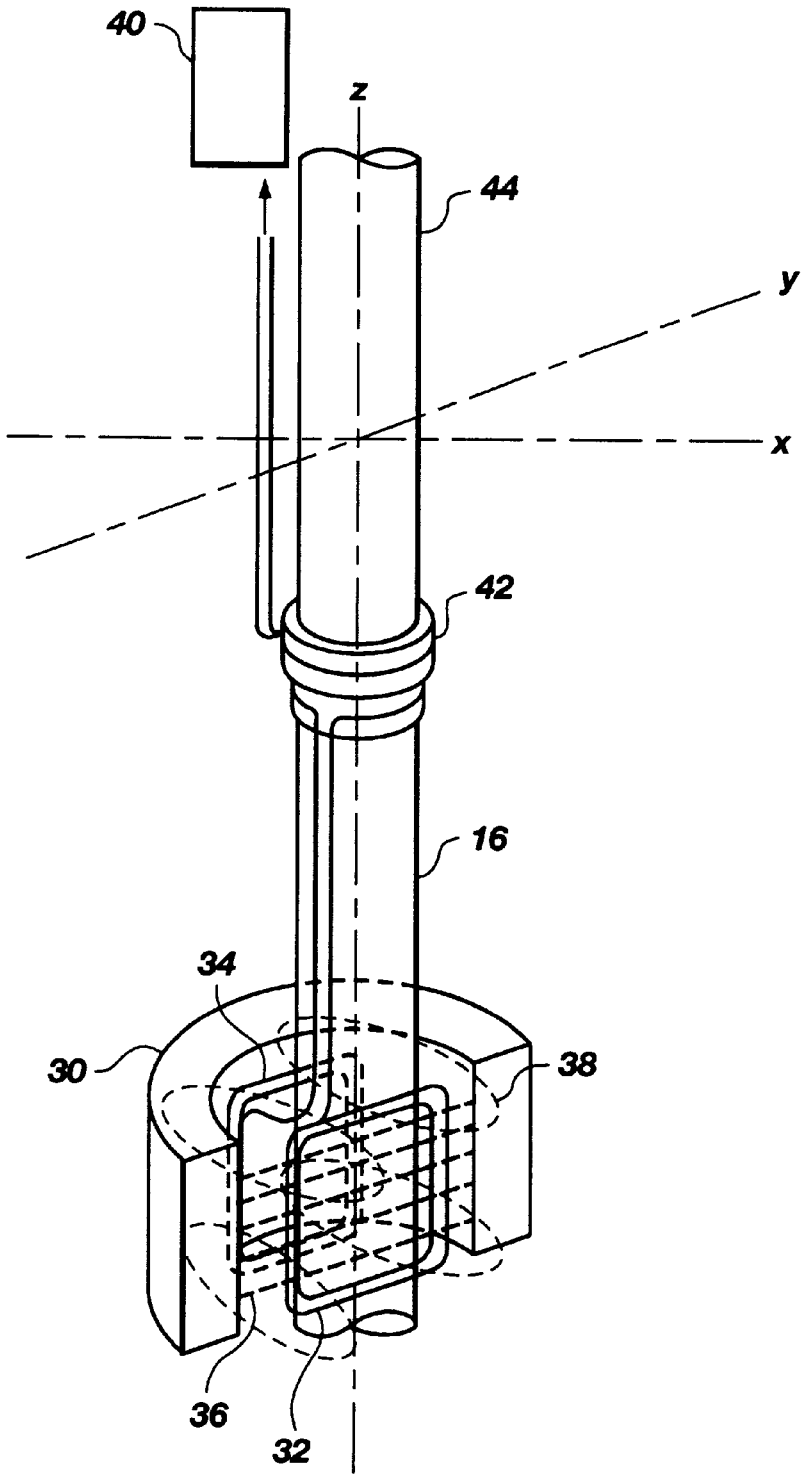
FIG. 3 is a schematic illustration showing the use of a segmented permanent magnet as the source of the DC field lines in the preferred embodiment.

Outside of the stationary core barrel 16, a permanent magnet 30 is disposed and can be seen better by looking at FIG. 3. The transmitting coil 32 and receiving coil 34 are disposed as shown in FIG. 3 so that the direct current field lines 36 are transverse to the RF field lines 38. The preferred embodiment illustrates the use of a permanent magnet 30; however, electromagnets can also be used without departing from the spirit of the invention. In the preferred embodiment, the magnet 30 has a C-shape, with an inwardly oriented DC field. This shape provides additional clearance in the annulus 22 to permit mud flow to the core bit 10. Thus, one of the advantages of the apparatus of the present invention is the ability to provide a nonrotating core barrel 16, while at the same time providing the necessary features for NMR measurement without materially restricting the mud flow in the annulus 22 to the core bit 10. Alternative shapes which have an inwardly oriented DC field are within the scope of the invention.

Continuing to refer to FIG. 3, the balance of the components is shown in schematic representation. A surface-mounted power source, generally referred to as 40, supplies power for the transmitter and receiver electronics, the power being communicated to a location below electronics 44 within sleeve 14 comprising a rotating joint such as a slip-ring connection or preferably an inductive coupling 42. Thus, the transition between the downhole electronics 44 (see FIG. 1) which rotates with sleeve 14 and coils 32 and 34, which are rotationally fixed with regard to core barrel 16, occurs through the inductive coupling 42. The inductive coupling 42 is the transition point between the end of the nonrotating core barrel 16 and the rotating ejection tube 45. In essence, the inductive coupling 42 incorporates a ferrite band on the core barrel 16 and a pick-up wire involving one or more turns on the rotating ejection tube 45. The rotating sleeve 14 supports the inductive coupling 42 with the transition between fixed and rotating components located within the inductive coupling 42.

Also illustrated in FIG. 1 is a kink or jog 46, which acts to break the core after it passes through the measurement assembly shown in FIG. 3. The breaking of the core can be accomplished by a variety of techniques not limited to putting a kink or jog 46 in the tube. Various other stationary objects located in the path of the advancing core within the nonrotating core barrel 16 can accomplish the breaking of the core. Accordingly, blades, grooves or knives can be used in lieu of the kink or jog 46. The breaking of the core facilitates the ultimate ejection of the core from the exit port 48 of the ejection tube 45.

With this layout, as illustrated, the driller can alter the weight on bit to meet the necessary conditions without affecting the integrity of the core.

Figure 2:
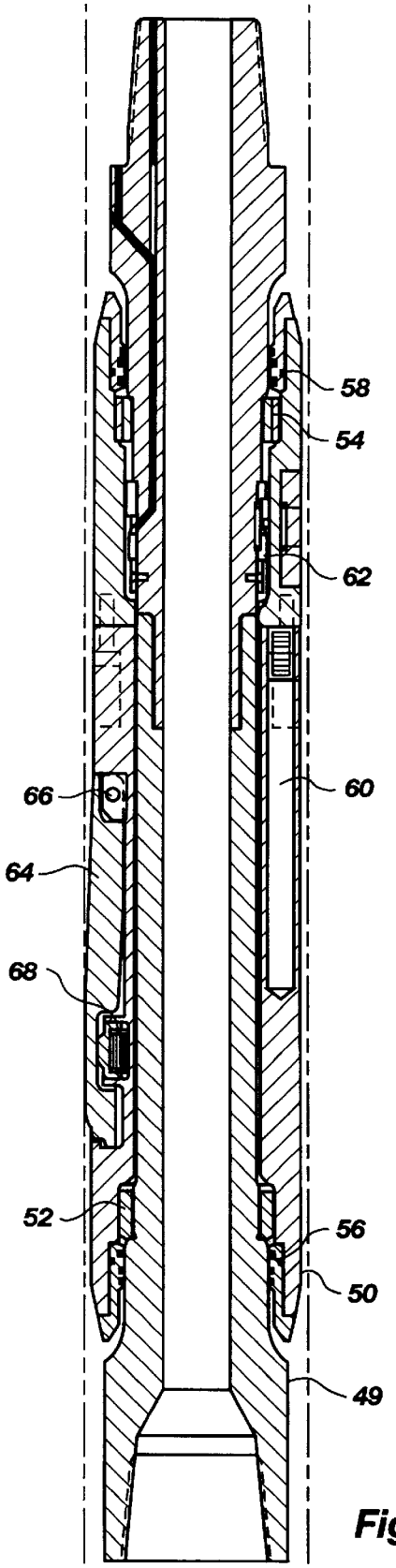
FIG. 2 is a sectional elevational view of the steering sub, with the arms in a retracted position.
Figure 2A:
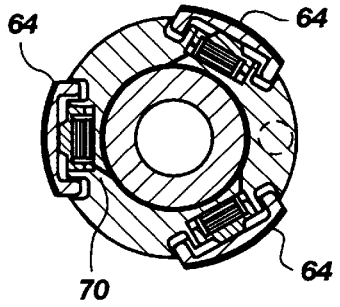
FIG. 2*a* is the view in section through FIG. 2, showing the disposition of the arms about the steering sub.

One of the concerns in drilling is to maintain the appropriate orientation of the bit as the drilling progresses. The desirable coring technique, which is illustrated by use of the apparatus as previously described, can be further enhanced by providing steering capability as the core is being taken. An additional sub can be placed in the assembly shown in FIG. 1, preferably as close to the core bit 10 as possible. This assembly can be made a part of the rotating sleeve 14 and is illustrated in FIGS. 2 and 2*a*. It has a rotating inner body 49 on which an outer body 50 is mounted using bearings 52 and 54. Seals 56 and 58 keep well fluids out of the bearings 52 and 54. As a result, the outer body 50 does not rotate with respect to rotating inner body 49.

The outer body 50 supports an inclinometer 60, which is a device known in the art. Power and output signals from the inclinometer pass through a slip ring 62 for ultimate transmission between the nonrotating outer body 50 and the rotating inner body 49. In the preferred embodiment, a plurality of arms 64 is oriented at 120 degrees, as shown in FIG. 2*a*. Each of the arms 64 is pivoted around a pin 66. Electrical power is provided which passes through the slip ring 62 into the outer body 50 and to a thrust pad 68 associated with each arm 64. Upon application of electrical power through wires such as wires 70 (see FIG. 2*a*), the thrust pad 68 expands, forcing out a particular arm 64. The arms 64 can be operated in tandem as a centralizer, or individually for steering, with real-time feedback obtained through the inclinometer 60. The closer the arms 64 are placed to the core bit 10, the more impact they will have on altering the direction of the core bit 10 while the core is being taken. In the preferred embodiment, the thrust pad 68 can be made of a hydro-gel, which is a component whose expansion and contraction can be altered by electrical, heat, light, solvent concentration, ion composition, pH, or other input. Such gels are described in U.S. Pat. Nos. 5,274,018; 5,403,893; 5,242,491; 5,100,933; and 4,732,930. Alternatively, a metal compound, such as mercury, which responds to electrical impulse with a volume change may be employed. Accordingly, with the feedback being provided from the inclinometer 60, electrical current or other triggering input can be controllably transmitted to the thrust pads 68 to obtain the desired change in orientation of the core bit 10 on the run while the core is being taken due to selective volume changes.

Those skilled in the art will appreciate with the disclosure of this invention that reliable coring while drilling techniques have been disclosed that give the ability, using NMR or other techniques, to obtain reliable readings of the core being taken as the drilling of the wellbore progresses. The apparatus reveals an ability to provide a nonrotating core barrel 16 without significantly impeding mud flow to the core bit 10 through an annulus 22. Additionally, with the core barrel 16 taking up much of the room within the rotating sleeve 14, the apparatus addresses another important feature of being able to steer the core bit 10, using real-time feedback from an inclinometer 60, all in an environment which does not lend itself to space for using more traditional actuation techniques for the arms 64. In other words, because the stationary core barrel 16 takes up much of the space within the rotating sleeve 14, traditional piston or camming devices for actuation of the arms 64 become impractical without dramatically increasing the outer diameter of the tool assembly.

The design using the bearing assemblies 18 and 24, along with seal assemblies 20 and 26, provides a mechanism for reliably taking a core and measuring its properties using known NMR techniques and other techniques without significant disturbance to the core after it is taken. Prior to ejecting the core and after testing the core, it is sufficiently disturbed and broken up to facilitate the smooth flow through the nonrotating core barrel 16 and ultimate ejection.

As an additional feature of the invention, effective steering is accomplished during the coring and measurement operation.

The foregoing disclosure and description of the invention are illustrative and explanatory thereof, and various changes in the size, shape and materials, as well as in the details of the illustrated construction, may be made without departing from the spirit of the invention.

What is claimed is:

1. A steering device for a boffomhole drilling assembly, comprising:

a housing securable to a drill string; and a body rotatably mounted with respect to said housing and carrying a plurality of circumferentially-spaced, selectively extendable and retractable arms, each arm of said plurality of arms comprising an elongated member extendable and retractable through respective outward and inward pivoting, relative to said rotatably mounted body, about a pivot point proximate one end of said elongated member.

2. The apparatus of claim 1, wherein said plurality of arms comprises three substantially equally circumferentially spaced arms.

3. The apparatus of claim 1, further including a selectively expandable and contractable thrust pad disposed between each arm of said plurality of arms at a location remote from said pivot point and a portion of said rotatably mounted body.

4. The apparatus of claim 3, wherein said thrust pads comprise a hydro-gel expandable and contractable through variance of a control input selected from a group comprising electricity, heat, light, solvent concentration, ion composition, and pH.

5. The apparatus of claim 3, wherein said thrust pads comprise a metal compound exhibiting a change in volume responsive to variance of an electrical control input.

6. The apparatus of claim 1, further comprising a bit secured to a lower end of said housing.

7. The apparatus of claim 1, wherein said housing comprises a sleeve of a coring apparatus having a core barrel disposed therewithin.

8. The apparatus of claim 7, further comprising a core bit secured to a lower end of said housing.

9. The apparatus of claim 8, further comprising a bit orientation indicator device carried by said rotatably mounted body and electrically powered through a slip ring connection between said rotatably mounted body and said housing.

10. The apparatus of claim 1, further comprising a bit orientation indicator device carried by said rotatably mounted body and electrically powered through a slip ring connection between said rotatably mounted body and said housing.

11. The apparatus of claim 10, further including a selectively expandable and contractable thrust pad disposed between at least a portion of each arm of said plurality of arms and a portion of said rotatably mounted body.

12. The apparatus of claim 11, wherein said thrust pads comprise a hydro-gel expandable and contrastable through variance of a control input selected from a group comprising electricity, heat, light, solvent concentration, ion composition, and pH.

13. The apparatus of claim 11, wherein said thrust pads comprise a metal compound exhibiting a change in volume responsive to variance of an electrical control input.

14. The apparatus of claim 11, wherein electrical power to said thrust pads is provided by said slip ring connection.

15. A steering device for a bottomhole drilling assembly, comprising:

a housing securable to a drill string;

a body rotatably mounted with respect to said housing and carrying a plurality of circumferentially-spaced, selectively extendable and retractable arms; and a selectively expandable and contractable thrust pad disposed between at least a portion of each arm of said plurality of arms and a portion of said rotatably mounted body, each of said thrust pads including a material selectively expandable and contractable responsive to variance of a control input;

wherein said material comprises a hydro-gel or a metal compound.

16. The apparatus of claim 15, further including a slip ring connection between said rotatably mounted body and said housing for providing electrical power to said thrust pads.

17. The apparatus of claim 15, wherein said control input is selected from a group comprising electricity, heat, light, solvent concentration, ion composition, and pH.

18. A steering device for a bottomhole drilling assembly, comprising:

a housing securable to a drill string; and a body rotatably mounted with respect to said housing and carrying a plurality of circumferentially-spaced, selectively extendable and retractable arms, each arm of said plurality of arms being selectively extendable and retractable responsive to activation and deactivation of a thrust pad associated with that arm, each of said thrust pads comprising a hydro-gel activatable and deactivatable through variance of a control input selected from a group comprising electricity, heat, light, solvent concentration, ion composition, and pH.

19. A steering device for a bottomhole drilling assembly, comprising:

a housing securable to a drill string; and a body rotatably mounted with respect to said housing and carrying a plurality of circumferentially-spaced, selectively extendable and retractable arms, each arm of said plurality of arms being selectively extendable and retractable responsive to activation and deactivation of a thrust pad associated with that arm, said thrust pads being comprised of metal responsive to variance of an electrical control input.

20. A steering device for a bottomhole drilling assembly, comprising:

a housing securable to a drill string; and a body rotatably mounted with respect to said housing and carrying a plurality of circumferentially-spaced, selectively extendable and retractable arms, each arm of said plurality of arms being selectively extendable and retractable responsive to activation and deactivation of a thrust pad associated with that arm, each arm of said plurality of arms being hinged to said rotatably mounted body at a longitudinally remote location from the said thrust pad associated with that arm.

* * * * *

UNITED STATES PATENT AND TRADEMARK OFFICE

CERTIFICATE OF CORRECTION

PATENT NO. : 6,148,933
APPLICATION NO. : 09/334279
DATED : November 21, 2000
INVENTOR(S) : Arthur D. Hay, Mike H. Johnson and Volker Krueger It is certified that error appears in the above-identified patent and that said Letters Patent is hereby corrected as shown below:

In the claims:

| | | | |
|---|---|---|---|
| CLAIM 1, | COLUMN 5, | LINE 21, | change “boffomhole” to --bottomhole-- |
| CLAIM 20, | COLUMN 6, | LINE 65, | change “the said trust” to --the thrust-- |

Signed and Sealed this

Fifth Day of June, 2007

JON W. DUDAS
*Director of the United States Patent and Trademark Office*